US006231170B1

(12) United States Patent
Wiedemann

(10) Patent No.: US 6,231,170 B1
(45) Date of Patent: May 15, 2001

(54) DEVICE FOR SUPPLYING INK TO AN INK RESERVOIR OF A PRINTER

(75) Inventor: Klaus Wiedemann, Diedorf (DE)

(73) Assignee: technotrans AG, Sassenberg (DE)

( * ) Notice: Subject to any disclaimer, the term of this patent is extended or adjusted under 35 U.S.C. 154(b) by 0 days.

(21) Appl. No.: 09/512,369

(22) Filed: Feb. 25, 2000

(30) Foreign Application Priority Data

Mar. 23, 1999 (DE) ..... 199 12 881

(51) Int. Cl.[7] ..... B41J 2/175
(52) U.S. Cl. ..... 347/85
(58) Field of Search ..... 347/84, 85, 86, 347/87, 5, 7, 19

(56) References Cited

U.S. PATENT DOCUMENTS 5,619,232 * 4/1997 Maeno ..... 347/30
6,022,101 * 2/2000 Sabonis ..... 347/84

* cited by examiner

*Primary Examiner*—N. Le
*Assistant Examiner*—Anh T. N. Vo
(74) *Attorney, Agent, or Firm*—Jones, Tullar & Cooper, P.C.

(57) ABSTRACT

The on-site assembly work can thus be minimized with a device for supplying ink to at least one compartment of an ink reservoir of a printer having at least one supply channel which extends beyond the respective ink reservoir area and is provided with outlet orifices assigned to the ink reservoir, the supply channel being connected to an ink supply line which is provided with a valve arrangement, and having at least one filling level sensor whose signals can be processed by means of a control unit to yield switching commands for an operating device assigned to the valve arrangement; this is accomplished by providing a multifunction rail that spans the respective ink reservoir area, having at least the supply channel with the respective outlet orifices and at least one insertion channel which is open at the bottom to accommodate at least one filling level sensor and being provided with covers at the ends, with at least one cover having at least one end area of an ink supply line and the valve arrangement assigned to it with the respective operating device.

14 Claims, 2 Drawing Sheets

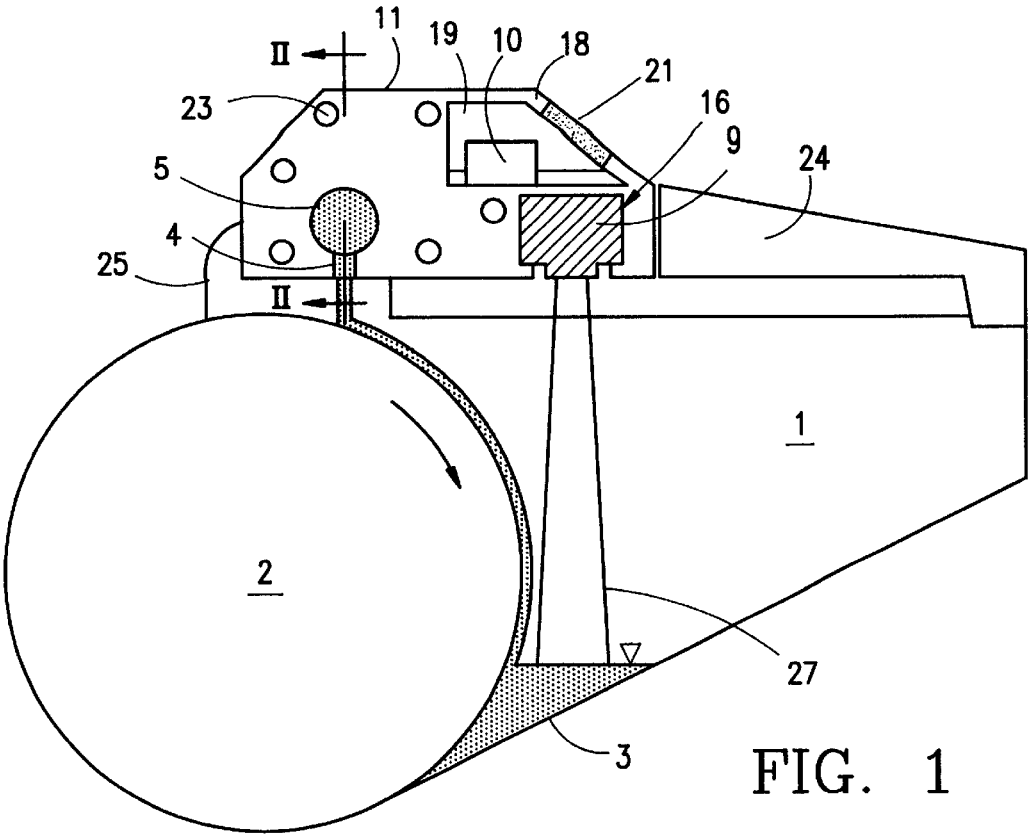
FIG. 1
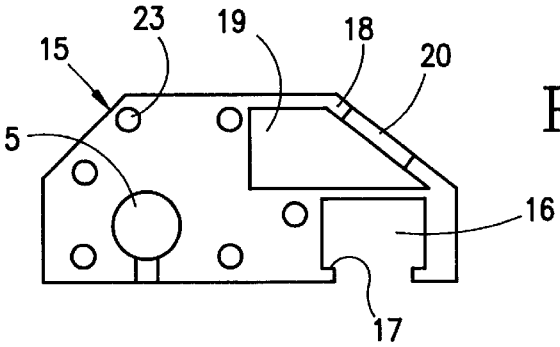
FIG. 3
FIG. 2
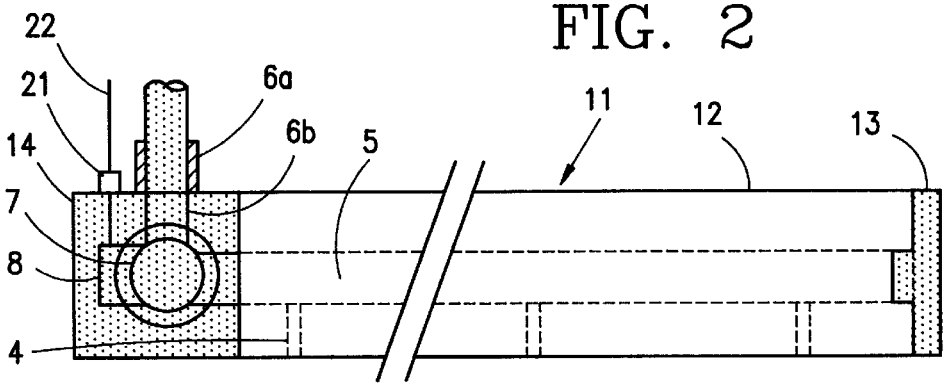

DEVICE FOR SUPPLYING INK TO AN INK RESERVOIR OF A PRINTER

FIELD OF THE INVENTION

This invention concerns a device for supplying ink to at least one compartment of an ink reservoir of a printer having at least one supply channel provided with outlet orifices assigned to the ink reservoir going beyond the respective ink reservoir area, the supply channel being connected to an ink supply line which is in turn provided with a valve arrangement, and having at least one filling level sensor whose signals can be processed by means of a control device to yield switching commands for an operating device provided for the valve arrangement.

PRIOR ART

The known devices of this type are assembled on site from the individual components. To form the supply channel, a filling tube is arranged above the ink cartridge, which is usually designed as an ink reservoir, and is connected to the ink supply line in which the valve arrangement is installed. As a rule, it is placed a distance away from the filling tube. The filling level sensor is mounted independently of the filling tube. Therefore, this yields a comparatively great on-site assembly expense, which has a negative effect on manufacturing cost and entails possible sources of error.

SUMMARY OF THE INVENTION

Therefore, against this background, the object of the present invention is to provide a device of the type mentioned with simple and inexpensive means, permitting standardization that reduces the required on-site assembly cost.

This object is achieved according to this invention by the fact that a multifunction rail which spans the respective ink reservoir area is provided and contains at least one supply channel with the respective outlet orifices and at least one insertion channel that is open at the bottom to accommodate at least one filling level sensor, and which is provided with covers on the end, with at least one cover having at least one end area of an ink supply line and containing the respective valve arrangement with the respective operating device.

These measures advantageously yield a structural unit in which the various function components are integrated. This structural unit can be completely preassembled at the factory in an advantageous manner, thus practically limiting the on-site assembly work to attaching the structural unit. Therefore, a high profitability is achieved with the measures according to this invention.

Advantageous embodiments and expedient refinements of the primary measures are characterized, for example, in that the multifunction rail may advantageously contain at least one additional channel into which the control unit assigned to the operating device can be inserted. This ensures that the required signal lines from the sensor to the control unit and from the latter to the operating device belong to the above-mentioned preassembled structural unit, thus eliminating any on-site wiring work.

To facilitate installation of the signal lines, one or more cable channels may be provided to advantage.

The channel assigned to the control unit may advantageously be bordered by a wall that is accessible from the outside and is provided with a recess into which the input device assigned to the control unit is inserted. This facilitates communication with the control unit and accordingly guarantees appropriate and easy operation.

Another advantageous measure may consist of at least one cover having at least one coupling element for the power input line connected to the respective consumers. These measures make it possible to create a plug-in arrangement.

In another refinement of the primary measures, the multifunction rail may be arranged so that it can be moved away from the ink reservoir, preferably by pivoting it away. This guarantees good accessibility to the interior of the ink reservoir and to a ductor that is optionally provided with it.

The multifunction rail may advantageously be expanded by at least one expanding strip, which can preferably be attached to expand it to the width of the ink reservoir. Together with the movability feature, this yields a removable ink reservoir cover which can prevent contamination of the ink by foreign bodies entering it from the outside.

Another measure that is especially preferred may consist of designing the multifunction rail with its area containing the outlet openings to extend over a ductor that is provided for the ink reservoir. The ductor applies ink to the gap formed between its surface and the ink blades, etc. in contact with it, so that so-called bare ductor processing need not be feared even if the filling level is very low. At the same time, these measures ensure that the filling level sensor will be in a position above the lower ink reservoir area, thus guaranteeing reliable monitoring even when the filling level is low.

Additional advantageous embodiments and expedient refinements of the primary measures are characterized in the remaining subordinate claims and can be derived from the following description of examples with reference to the drawings.

BRIEF DESCRIPTION OF THE DRAWINGS

FIG. 1 is a cross-section through a device according to this invention with a closed ink reservoir designed as an ink cartridge, FIG. 2 is a section along line II/II in FIG. 1 in a schematic diagram, FIG. 3 is a cross-section through the hollow chamber section on which the multifunction rail is based.

DETAILED DESCRIPTION

Figure 4:
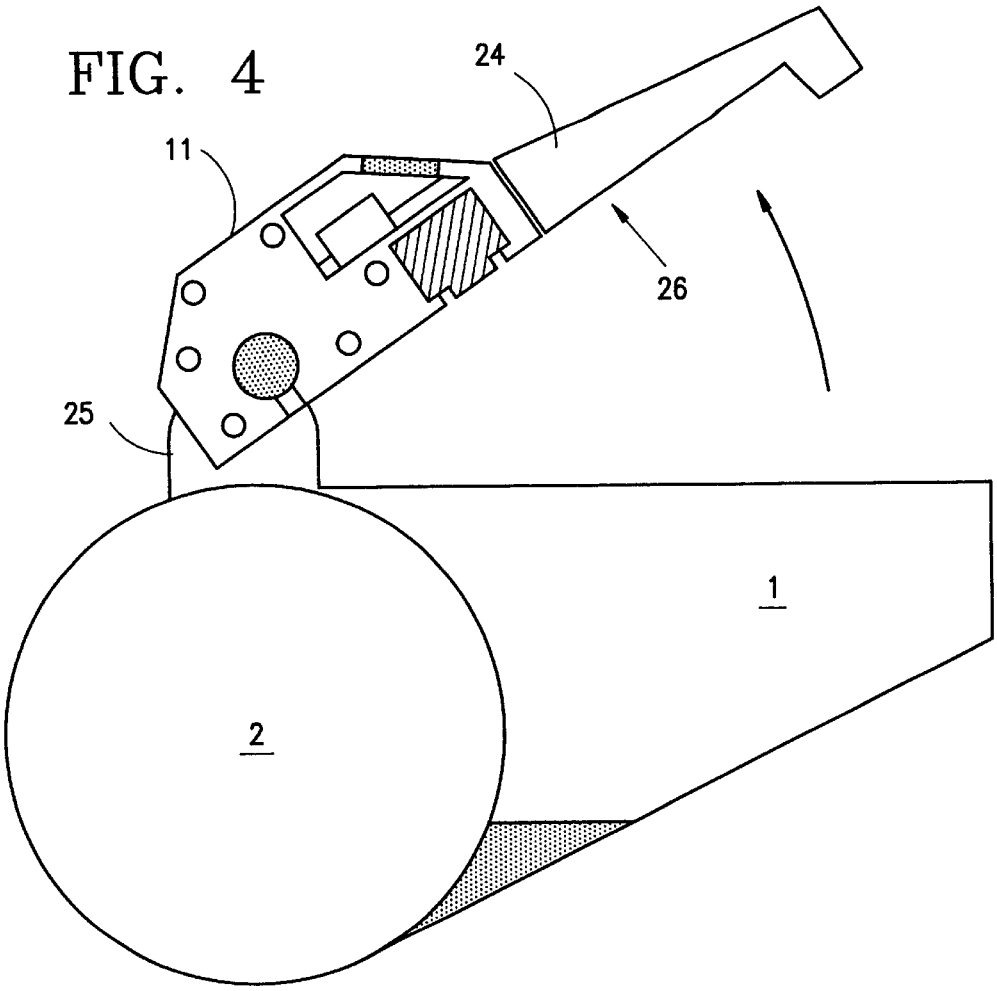
FIG. 4 shows the arrangement according to FIG. 1 with the ink reservoir cover opened.

The basic design and functioning of printers and printer ink systems are essentially known and therefore need not be explained further in the present context.

The detail of a printer ink system on which FIG. 1 is based shows a driven ductor 2 arranged in an ink cartridge 1 forming an ink reservoir. The ink cartridge 1 contains an ink supply 3 located in the gap between the ductor 2 and its bottom, which is in contact with it in the form of ink blades. Ink is fed into the ink cartridge 1 through a supply device having a supply channel 5 which is provided with outlet orifices 4 that are open toward the bottom and it is connected to an ink supply line 6*a, b* as indicated in FIG. 2; said ink supply line can be opened and closed by means of a valve 7 which has an operating device 8. The height of the filling level in the ink cartridge 1 is sensed by means of a filling level sensor 9, as also shown in FIG. 1, and its signals can be processed by control unit 10 to yield switching signals for the operating device 8.

The supply system described above can be combined into one module. To do so, there is a multifunction rail 11 on which the above-mentioned components are accommodated, the rail being arranged above the ink cartridge 1 and extending beyond it or, in the case of a divided ink cartridge, extending beyond a respective ink cartridge compartment along the entire length. As shown in FIG. 2, multifunction rail 11 has a middle part 12 which is provided with axial channels and is sealed at the end by covers 13 and 14 which are preferably screwed on. To form the middle part 12, a section of a corresponding hollow chamber section 15 on which FIG. 3 is based may be used. This hollow chamber section may be made of lightweight metal such as aluminum in the form of an extruded and press-drawn section. Then only subsequent machining required is to produce recesses running across the channels.

The hollow chamber section 15 forming the base of middle part 12 contains several continuous channels in the longitudinal direction provided for the individual components of the ink supply device. A first channel designed in the manner of a through-hole adjacent to the lower edge of the multifunction rail 11 forms the above-mentioned supply channel 5 which receives ink. To form the outlet orifices 4 that are open at the bottom, the hollow chamber section forming the base of the multifunction rail 11 is provided with corresponding holes which must be produced subsequently as mentioned above.

In addition to the supply channel 5, there is also an insertion channel 16 which is open at the bottom and has undercut edge strips 17. The filling level sensor 9 is inserted into the insertion channel 16 as shown in FIG. 1. The edge strips 17 may function as guide strips. The filling level sensor 9 is inserted from the side into the respective insertion channel 16 and is secured in the desired location, e.g. at the center of the middle part 12 of the multifunction rail 11 by a clamping connection.

Above the insertion channel 16 which is open at the bottom, there is another channel 19 which functions as the receiving chamber for the printed circuitboard that forms the control unit 10, said channel being bordered on the outside by a wall 18 of the hollow chamber section 15, said wall being accessible at an oblique angle from above. The wall 18 is provided with a recess 20 as shown in FIG. 3. An input device 21, preferably in the form of a film keyboard, is inserted into this recess in FIG. 1, permitting communication with the control unit 10, e.g. permitting input of the desired minimum filling levels, etc.

One of the end covers, namely cover 14 in the example according to FIG. 2 shown here, has a line section **6*b* of the ink supply line which communicates with the supply channel 5 and has the valve arrangement 7 and the respective operating device 8. The line section 6*b* which leads over the valve arrangement 7 and may be designed as a borehole system is connected to a tube 6*a* which ends at the cover 14 and may preferably be attached by pushing it on. The attached tube 6*a* and the line section 6*b*** form the ink supply line.

One of the covers, likewise cover 14 here, also has an input connection 21 for attaching a power supply line, designed here as an electric cable. All the power consumers of multifunction rail 11 are connected to the input connection 21. The connecting lines are not shown here for the sake of simplicity. If consumers of other forms of energy such as compressed air consumers are also provided here in addition to consumers of electric power, connection option(s) for these energy utilities will also be provided in the area of one cover.

A signal line (not shown in detail here) leads from the filling level sensor 9 to control unit 10 from which a signal line (also not shown here) leads to the operating device 8. The hollow chamber section 15 which forms the middle part 12 of the multifunction rail 11 is provided with cable ducts or channels as indicated by 23, for example, to accommodate these signal lines and the above-mentioned power supply lines (also not shown). In many cases, the cables and lines may also be installed in channels such as channel 19 which are provided for other purposes at the same time. The other holes not shown in detail here may be the fastening holes provided for the screw connections for the covers 13, 14.

The multifunction rail 11 is provided with an expanding attachment 24 in the example shown here as indicated in FIGS. 1 and 4, yielding on the whole a width which covers the ink cartridge 1. The expanding attachment 24 may be integrally molded. In the example shown here, the expanding attachment 24 is designed as an expanding strip that can be attached to the multifunction rail 11. The hollow chamber section 15 and the covers 13, 14 are provided with suitable connecting surfaces accordingly. The multifunction rail 11 is preferably mounted so it can be pivoted. To do so, the ink cartridges may be provided with bearing blocks 25 accordingly. This yields a swivel cover formed by multifunction rail 11 with expanding attachment 24, which closes the ink cartridge 1 at the top in the normal operating position on which FIG. 1 is based and can be pivoted upward to provide good accessibility to the interior of the ink cartridge 1 and to ductor 2 as indicated by 26 in FIG. 4. Instead of being pivotable, it may also be laterally displaceable, etc.

The multifunction rail 11 is positioned above the ink cartridge 1 in such a way that with its area containing the outlet orifices 4 it is positioned above the ductor 2. Therefore, the ink coming through the outlet orifices 4 is conveyed through the rotating ductor 2 into the gap between the ductor surface and the bottom of the ink cartridge. The filling level sensor 9 accommodated in the insertion channel 16 is very close to ductor 2 and accordingly is above the bottom area of the ink cartridge 1, so that sensor beams 27 also detect a very low filling level. This guarantees that operation will be possible even with a comparatively low ink supply 3. In this way the ink loss which is unavoidable in the case of an ink change can be minimized.

Figure 5:
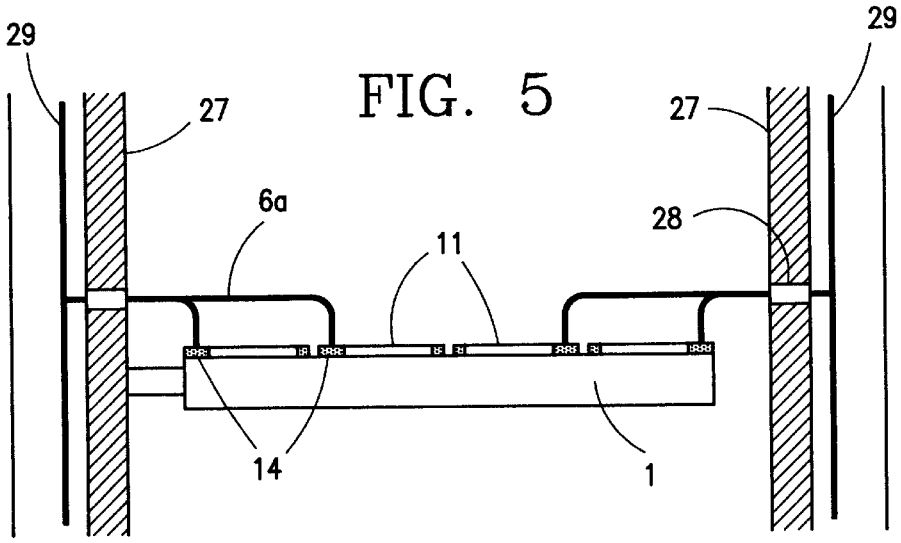
FIG. 5 is a front view of a divided ink reservoir with several devices according to this invention built into a printer.

In the case of an undivided ink cartridge, the multifunction rail 11 extends over the entire length of the ink cartridge, as indicated above. In the case of a subdivided ink cartridge, as shown in FIG. 5, multiple multifunction rails 11 are provided side by side, each extending over the respective compartment. In the example on which FIG. 5 is based, four multifunction rails 11 are provided, arranged in pairs symmetrically with the central longitudinal plane in such a way that their covers 14, which are incorporated into the ink supply line, are facing the adjacent machine side wall 27. The machine side walls 27 are provided with perforations 28 through which the tubes **6*a* of the ink supply line leading to the covers 14 can pass. An ink line 29 to which the tubes 6*a* can be connected is installed in each machine side wall 27** and is provided with main cutoff devices in a known way.

In the especially preferred embodiment shown here, each multifunction rail 11 has a decentralized control unit 11. As an alternative, it would of course also be conceivable for the signals of the filling level sensors 9 to be over a data line to a central control unit, such as the main computer of the printer, and to have the operating devices 8 controlled by this central control unit. Likewise, it would also be conceivable to provide several supply channels that can be assigned to inks of different colors, ink being supplied to the supply channels from a common cover having several valve arrangements or from opposing covers.

What is claimed is:

1. A device for supplying ink to at least one compartment of an ink reservoir of a printer, having at least one supply channel which is provided with outlet orifices assigned to the ink reservoir and extending beyond a respective ink reservoir area, said supply channel being connected to an ink supply fine which is in turn provided with a valve arrangement, and having at least one filling level sensor whose signals can be processed by means of a control unit to yield switching commands for an operating device provided for the valve arrangement, whereby a multifunction rail which spans the respective ink reservoir area is provided and contains at least one supply channel with respective outlet orifices and at least one insertion channel which is open at the bottom to receive at least one filling level sensor and which is provided with covers on end, with at least one cover having at least one end area of said ink supply line as well as the valve arrangement provided for it together with the respective operating device.

2. A device according to claim 1, whereby the multifunction rail has at least one additional channel into which the control unit provided for the operating device can be inserted.

3. A device according to claim 2, whereby the at least one additional channel provided for the control unit is bordered by a wall that is accessible from the outside and is provided with a recess into which is inserted an input device that is provided with the control unit and is preferably a film keyboard.

4. A device according to claim 1, whereby the multifunction rail has at least one cable conduit.

5. A device according to claim 1, whereby at least one cover has at least one coupling element connected to the respective consumers for at least one power supply line.

6. A device according to claim 1, whereby the multifunction rail is arranged so that it can be moved away from the ink reservoir.

7. A device according to claim 6, whereby the multifunction is arranged pivotable away from the ink reservoir.

8. A device according to claim 1, whereby the multifunction rail is integrated into a cover provided for the ink reservoir.

9. A device according to claim 8, whereby the multifunction rail is widened at least to the width of the ink reservoir by means of a respective expanding strip.

10. A device according to claim 1, whereby the multifunction rail together with its area containing the outlet orifices extends beyond a ductor provided for the ink reservoir.

11. A device according to claim 1, whereby a portion of a hollow chamber section is provided to form the area of the multifunction rail which runs between the covers.

12. A device according to claim 1, whereby a section of the ink supply line which runs outside the multifunction rail passes through an opening in an adjacent machine side wall and can be connected an ink line running in the machine side wall.

13. A device according to claim 1, whereby the section of the ink supply line as an attachable tube.

14. A device according to claim 1, whereby with an ink reservoir divided into several sections, a multifunction rail is provided for each section, with the multifunction rails provided over the width of the machine being arranged symmetrically with respect to the central longitudinal plane of the machine, where the covers that are incorporated into the ink supply each point toward the adjacent machine side wall.

* * * * *